US011646146B2

(12) United States Patent
Lee et al.

(10) Patent No.: US 11,646,146 B2
(45) Date of Patent: May 9, 2023

(54) COIL COMPONENT

(71) Applicant: SAMSUNG ELECTRO-MECHANICS CO., LTD., Suwon-si (KR)

(72) Inventors: Young Il Lee, Suwon-si (KR); Jeong Gu Yeo, Suwon-si (KR); Ji Hoon Hwang, Suwon-si (KR); Myoung Ki Shin, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 337 days.

(21) Appl. No.: 16/879,025

(22) Filed: May 20, 2020

(65) Prior Publication Data

US 2021/0175001 A1 Jun. 10, 2021

(30) Foreign Application Priority Data

Dec. 10, 2019 (KR) ..... 10-2019-0163946

(51) Int. Cl.

| | |
|---|---|
| ***H01F 27/255*** | (2006.01) |
| ***H01F 17/00*** | (2006.01) |
| ***H01F 27/28*** | (2006.01) |
| ***H01F 27/32*** | (2006.01) |

(52) U.S. Cl.

CPC ..... *H01F 27/255* (2013.01); *H01F 17/0013* (2013.01); *H01F 27/2885* (2013.01); *H01F 27/32* (2013.01)

(58) Field of Classification Search

CPC ..... H01F 27/255; H01F 17/0013; H01F 27/2885; H01F 27/32

See application file for complete search history.

(56) References Cited

U.S. PATENT DOCUMENTS

| | | | | |
|---|---|---|---|---|
| 2014/0132387 | A1 | 5/2014 | Shin | |
| 2015/0115766 | A1* | 4/2015 | Taguchi | B22F 5/106 336/233 |
| 2017/0236633 | A1* | 8/2017 | Park | H01F 17/04 336/55 |
| 2018/0019051 | A1 | 1/2018 | Bong et al. | |
| 2018/0211762 | A1* | 7/2018 | Jung | H01F 27/292 |
| 2019/0198234 | A1 | 6/2019 | Jung et al. | |

FOREIGN PATENT DOCUMENTS

| | | | |
|---|---|---|---|
| JP | 2004-253434 | A | 9/2004 |
| KR | 10-2014-0061036 | A | 5/2014 |
| KR | 10-1832614 | B1 | 2/2018 |
| KR | 10-2019-0078884 | A | 7/2019 |

* cited by examiner

*Primary Examiner* — Carlos Amaya

(74) *Attorney, Agent, or Firm* — Morgan, Lewis & Bockius LLP

(57) ABSTRACT

A coil component includes a body comprising a support member and a coil portion embedded in one surface of the support member; and external electrodes connected to the coil portion, wherein the body comprises a plurality of metal particles, at least some of the plurality of metal particles comprises a plastically deformable first particle, and at least some of the first particles have a deformed surface and thus have a shape corresponding to a surface of a neighboring magnetic metal particle.

18 Claims, 5 Drawing Sheets

COIL COMPONENT

CROSS-REFERENCE TO RELATED APPLICATION(S)

This application claims benefit of priority to Korean Patent Application No. 10-2019-0163946 filed on Dec. 10, 2019 in the Korean Intellectual Property Office, the disclosure of which is incorporated herein by reference in its entirety.

BACKGROUND

1. Field

The present disclosure relates to a coil component.

2. Description of Related Art

In accordance with the miniaturization and thinning of electronic devices such as a digital television (TV), a mobile phone, a laptop computer, and the like, miniaturization and thinning of coil components used in such electronic devices have been demanded. In order to satisfy such demand, research and development of various winding type or thin film type coil components have been actively conducted.

A main issue depending on the miniaturization and thinning of the coil component is to implement characteristics equal to characteristics of an existing coil component in spite of the miniaturization and thinning. In order to satisfy such demand, a ratio of a magnetic material should be increased in a core in which the magnetic material is filled. However, there is a limitation in increasing the ratio due to a change in strength of a body of an inductor, frequency characteristics depending on insulation properties of the body, and the like.

As an example of a method of manufacturing the coil component, a method of implementing the body by stacking and then pressing sheets in which magnetic particles, a resin, and the like, are mixed with each other on coils has been used. Fe-based alloys, or the like, have been used as an example of the magnetic particle to improve saturation magnetic flux density.

SUMMARY

An aspect of the present disclosure is to provide enhanced characteristics of a coil component including a magnetic metal powder. To this end, magnetic characteristics of the coil component are to be enhanced by improving a packing rate of the magnetic metal powder in a body.

According to an aspect of the present disclosure, a coil component may include a body comprising a support member and a coil portion embedded in one surface of the support member; and external electrodes connected to the coil portion, wherein the body contains a plurality of metal particles, at least some of the plurality metal particles containing a plastically deformable first particle, and at least some of the first particles have a deformed surface and thus have a shape corresponding to a surface of a neighboring magnetic metal particle.

In an exemplary embodiment, the first particle may contain a Fe-based crystalline material.

In an exemplary embodiment, the first particle may contain pure iron.

In an exemplary embodiment, the surface of the first particle may have a shape corresponding to a surface of a neighboring first particle due to its plastically deformable characteristic.

In an exemplary embodiment, the surface of the first particle may have a concave portion, and the surface of the neighboring first particle may have a convex portion in the form of being inserted into the concave portion.

In an exemplary embodiment, the plurality magnetic metal particles contain a second particle having a larger diameter than the first particle.

In an exemplary embodiment, the second particle may be formed of a material not plastically deformable.

In an exemplary embodiment, the second particle may contain a Fe-based amorphous alloy.

In an exemplary embodiment, the first particle may contain a Fe-based crystalline.

In an exemplary embodiment, at least some of the second particle may have a spherical shape, and the first particle neighboring the spherical second particle may have a shape corresponding to the surface of the spherical second particle.

In an exemplary embodiment, the first particle may have a particle size of 10 μm or less, and the second particle may have a particle size of 20 μm or above.

In an exemplary embodiment, the coil component may further include an insulating layer covering the surface of the coil portion.

In an exemplary embodiment, the insulating layer may have an integrated structure covering a side surface and an upper surface of the coil portion.

In an exemplary embodiment, the insulating layer may contain F-type parylene.

In an exemplary embodiment, the insulating layer may include a first layer covering the side and upper surfaces of the coil portion, and a second layer covering the first layer.

In an exemplary embodiment, the first layer may contain parylene, and the second layer may contain an epoxy resin.

In an exemplary embodiment, the insulating layer may include a first layer formed along the surface of the coil portion while covering the side and upper surfaces of the coil portion, and the second layer covering the first layer.

In an exemplary embodiment, the first layer is anatomic layer deposition (ALD) layer, and the second layer comprises parylene.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
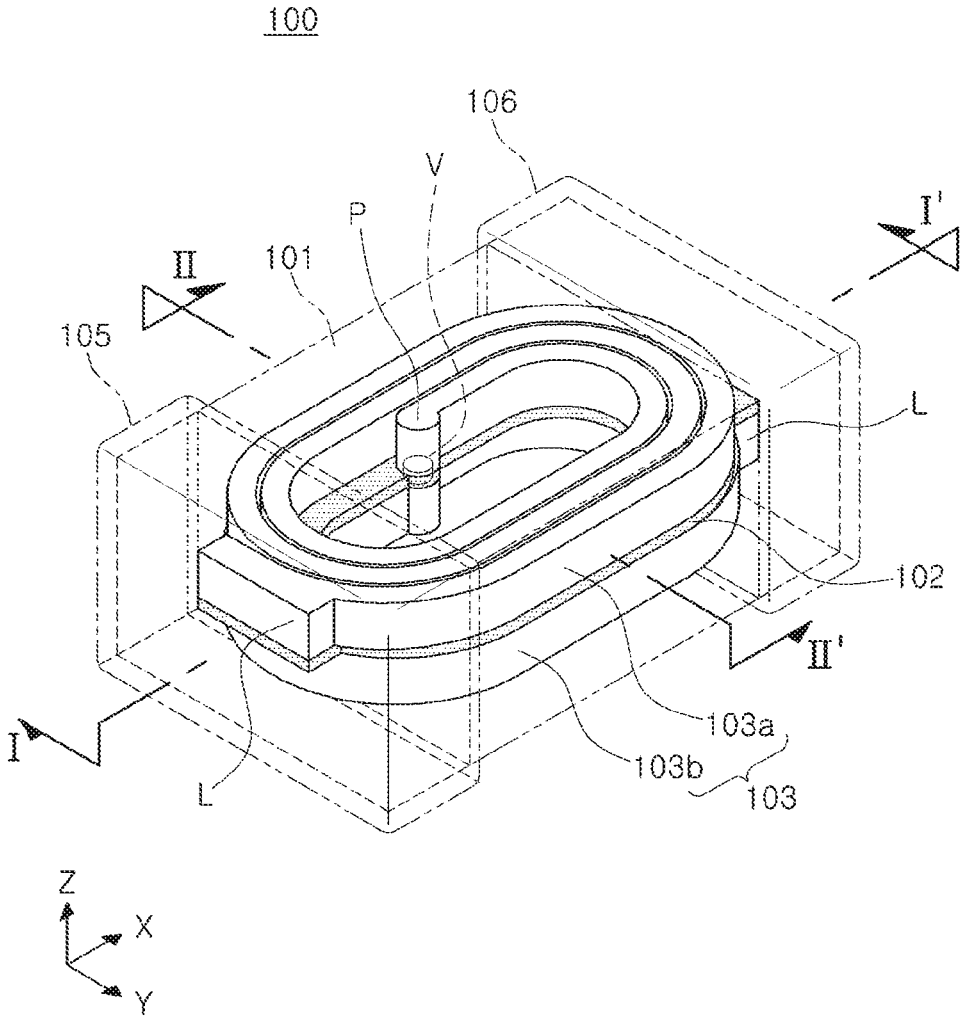
FIG. 1 is a schematic perspective view illustrating a coil component according to an exemplary embodiment in the present disclosure.

Hereinafter, exemplary embodiments of the present disclosure will be described in detail. However, the present disclosure may be embodied in many different forms and should not be construed as being limited to the embodiments set forth herein. Rather, these embodiments are provided so that this disclosure will be thorough and complete, and will fully convey the scope of the invention to those skilled in the art. Accordingly, the shapes and dimensions of elements in the drawings may be exaggerated for clarity, and the same reference numerals will be used throughout to designate the same or like elements.

Figure 2:
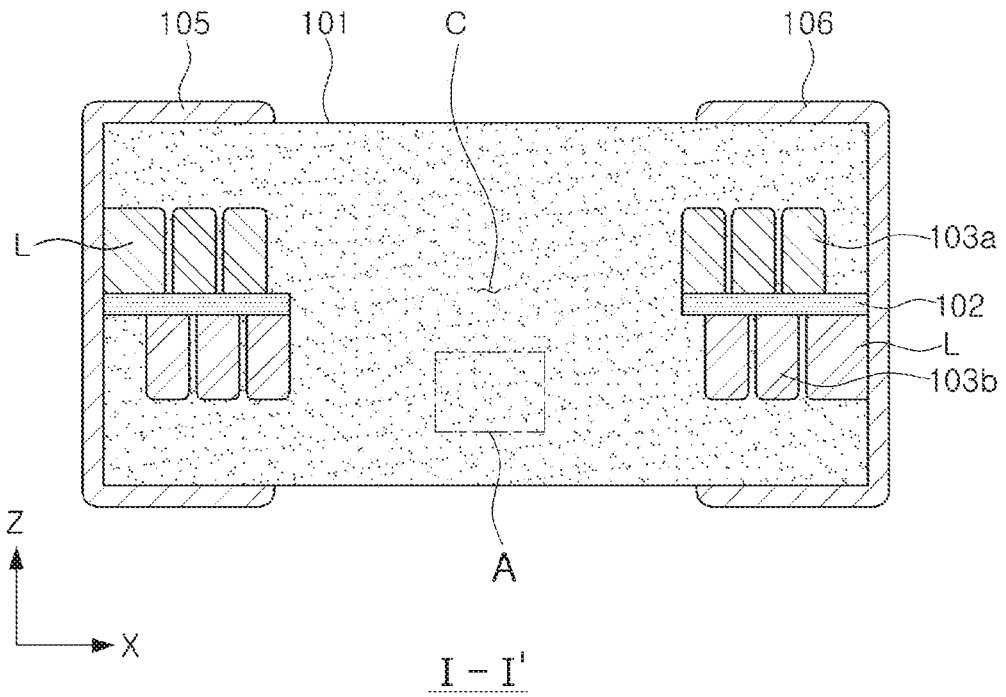
FIGS. 2 and 3 are cross-sectional views of the coil component of FIG. 1 respectively taken along lines I-I' and respectively.
Figure 3:
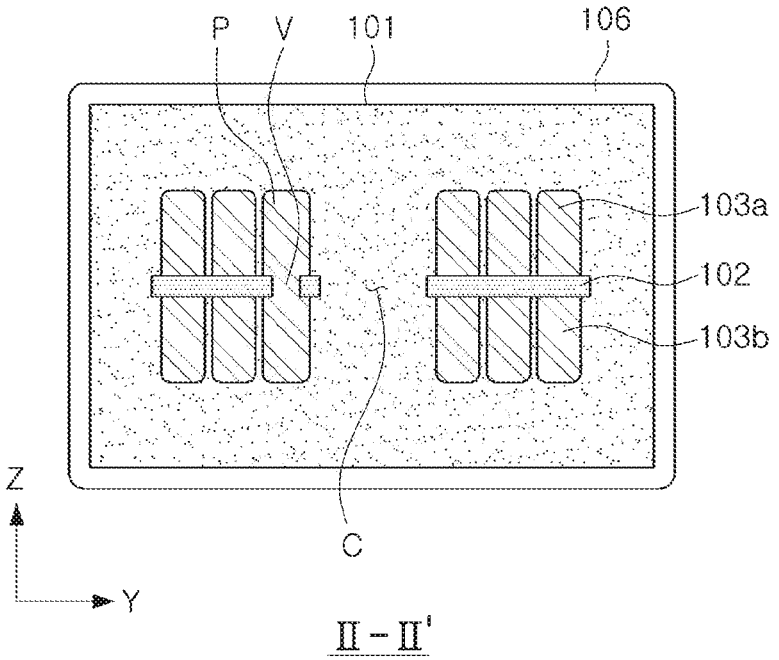
Figure 4:
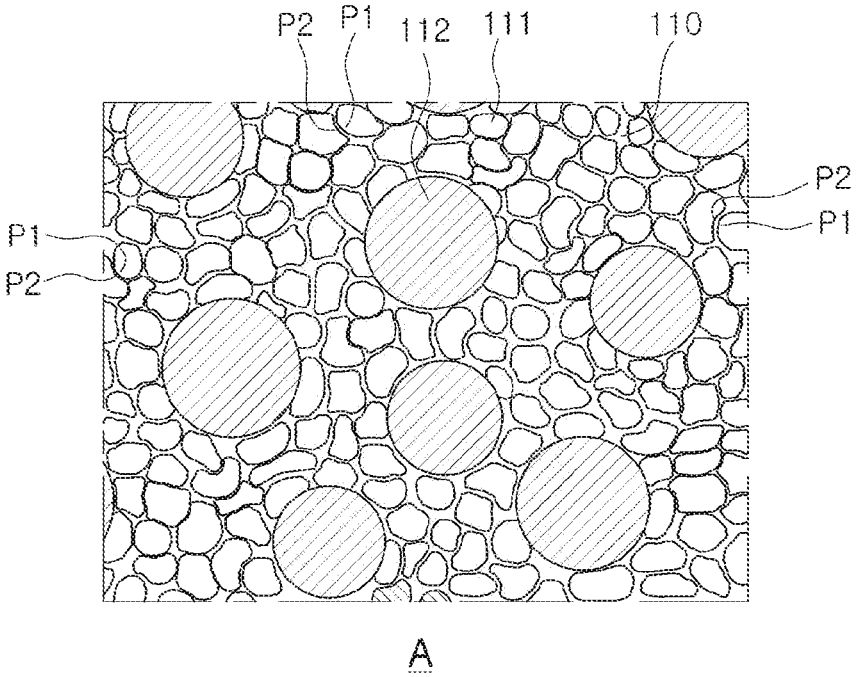
FIGS. 4 and 5 are enlarged views illustrating a body region in the coil component of FIG. 2.
Figure 5:
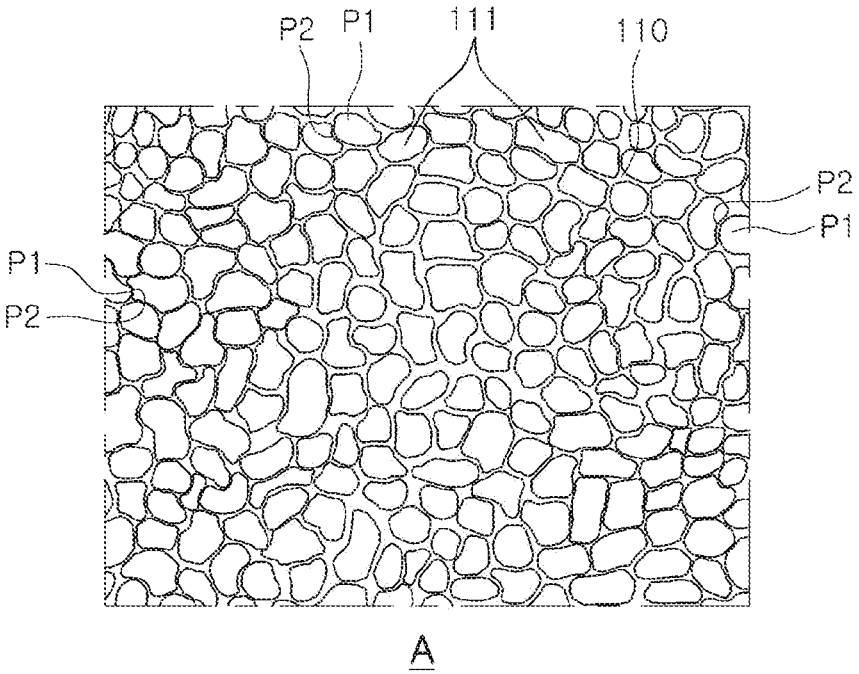

FIG. 1 is a schematic perspective view illustrating a coil component according to an exemplary embodiment in the present disclosure, and FIGS. 2 and 3 are cross-sectional views of the coil component of FIG. 1 respectively taken along lines I-I' and II-II'. FIGS. 4 and 5 are enlarged views illustrating a body region in the coil component of FIG. 2.

Referring to FIG. 1, a coil component 100 according to an exemplary embodiment has a structure mainly including a body 101 embedded with a support member 102 and a coil portion 103, and external electrodes 105 and 106. As illustrated in FIGS. 4 and 5, the body 101 contains a plurality of magnetic metal particles, and at least some of the plurality of the magnetic metal particles contain plastically deformable first particles 111. At least some of the first particles 111 have a deformed surface and thus have a shape corresponding to surfaces of neighboring magnetic metal particles.

The body 101 seals the support member 102, the coil portion 103, and the like, to protect the same, or may form an exterior of the coil component 100. As illustrated in FIG. 4, the body 101 includes a plurality of magnetic metal particles. In this case, the body 101 may be in the form in which the magnetic metal particles are dispersed in an insulating body 110 formed of a resin, or the like. The insulating body 110 may be formed of a thermosetting resin, a thermoplastic resin, a wax-based material, an inorganic material, or the like. The magnetic metal particles 111 and 112 may contain a Fe-based alloy or pure Fe, which has excellent magnetic characteristics. As described above, the plurality of magnetic metal particles contain a first particle 111 which is plastically deformable. Further, as illustrated in FIG. 4, the plurality of magnetic metal particles include a second particle 112 having a larger diameter than the first particle 111. In the case of the present exemplary embodiment, the body 101 can be molded under high pressure by forming the first particle 111 with a plastically deformable material. Accordingly, a packing rate of the first and second particles 111 and 112 may be improved in the body 101. This will be described in more detail below.

Due to characteristics that the coil of the coil portion 103 expresses, the coil portion 103 plays various roles in an electronic device. For example, the coil portion 100 may be a power inductor, which is a case in which the coil portion 103 stores electricity in a magnetic field to maintain an output voltage, thereby stabilizing power. To this end, the coil portion 103 may have a spiral shape forming at least one turn and may be formed on at least one surface of the support member 102. In the exemplary embodiment, the coil portion 103 is illustrated to include first and second coil patterns 103*a* and 103*b* disposed on two surfaces of the support member 102 opposing each other. In this case, the first and second coil patterns 103*a* and 103*b* may contain a pad region P and may be connected to each other via a via V penetrating the support member 102. Such coil patterns 103*a* and 103*b* may be formed by a method used in the art such as a plating method, for example, pattern plating, anisotropic plating, isotropic plating, or the like, and may be formed to have a multilayer structure using a plurality of said methods. As illustrated in the drawings, the coil patterns 103*a* and 103*b* may have a core region C in a center region. A material forming the body 101 may be filled in the core region C of the coil pattern 103.

A lead pattern L is disposed in an outermost region of the coil portion 103 to provide a connection path with the external electrodes 105 and 106 and may be integrally formed with the coil portion 103. In this case, as illustrated in the drawings, the lead pattern L may have a larger width than the coil pattern 103 to be connected to the external electrodes 105 and 106. As used herein, the term "width" refers to a width in an X direction based on FIG. 1.

The support member 102 supporting the coil portion 103 may be formed of a polypropylene glycol (PPG) substrate, a ferrite substrate, a metal-based soft magnetic substrate, or the like. In this case, a through-hole may be formed in a center region of the support member 102, and a magnetic material may be filled in the through-hole to form a core region C. The core region C constitutes a portion of the body 101. As described above, the core region C filled with the magnetic material may be formed to improve performance of the coil component 100.

The external electrodes 105 and 106 may be formed outside of the sealing member 101 to be connected to the lead pattern L. The external electrodes 105 and 106 may be formed of a paste containing a metal having excellent electrical conductivity, for example, a conductive paste containing nickel (Ni), copper (Cu), tin (Sn), silver (Ag), or alloys thereof. In addition, a plating layer may be further formed on the external electrodes 105 and 106. In this case, the plating layer may contain at least one selected from the group consisting of nickel (Ni), copper (Cu) and tin (Sn); for example, a nickel (Ni) layers and a tin (Sn) layer may be sequentially formed.

As previously described, the magnetic metal particles 111 and 112 contain the first and second particles 111 and 112, and a particle size of the first particle 111 is larger than that of the second particle 112. A packing rate of the magnetic metal particles 111 and 112 in the body 101 can be improved by employing the first particle 111 plastically deformable and having a relatively small particle size. The first particle may have a particle size of 10 μm or less, and the second particle may have a particle size of 20 μm or above. The particle size can be measured by a method optical microscopy, sieving, sedimentation or particle volume measurement, which is appreciated by the one skilled in the art.

The first particle 111 is a plastically deformable metal particle and contains, for example, a Fe-based crystalline material. Specifically, the first particle 111 may contain pure iron, for example, carbonyl iron powder (CIP). When the body 101 is formed by high pressure molding, at least a portion of the first particle 111 is plastically deformed, and accordingly, a surface thereof may have a shape corresponding to a surface of a neighboring first particle 111. As used herein, the expression "shape corresponding to a surface" of another particle refers to a shape of at least a portion of the surface of the first particle 111, modified to be similar or substantially identical to a surface of a neighboring first particle 111. As an example of such a form, the surface of the first particle 111 includes a concave portion P1, and the surface of the neighboring first particle has a convex portion P2 in the form of being inserted into the concave portion P1 as shown in FIG. 4. In this case, the first particle 111 may be in contact with the neighboring first particle 111, or an insulating body 110, or the like, may be disposed therebetween without the first particle and the neighboring first particle being in contact with each other. As the first particle 111 is plastically deformed and thus has the previously described surface, a packing rate of the magnetic metal particles 111 and 112 may increase. As used herein, the term "packing rate" may be defined as a volume accounted for by the magnetic metal particles 111 and 112 in the body 101.

The second particle 112 is a larger particle size, compared to the first particle 111. Use of particles having different diameter distributions facilitates the packing rate of the magnetic metal particles 111 and 112 to increase in the body 101 compared to when a single type of a particle is used. In contrast to the first particle 111, the second particle 112 may be a material which is not plastically deformed. To this end, the second particle 112 may contain a Fe-based amorphous alloy. Specifically, the second particle 112 may contain at least one selected from the group consisting of Fe, Si, Cr, B and Ni; for example, the second particle 112 may be an amorphous Fe—Si—B—Cr metal, but is not necessarily limited thereto. As a more specific example, the magnetic metal particle 111 a d 112 may be formed of a Fe—Si—B—Nb—Cr alloy, a Fe—Ni alloy, or the like. As used herein, the expression "second particle 112 not plastically deformed" refers to having a lower plastic deformability than the first particle, when the expression does not mean that no plastic deformation occurs at all, but is rather considered that there is barely a plastic deformation and thus has substantially no plastic deformation.

At least some of the second particle 112 having low plastic deformability maintains a spherical shape as illustrated in the drawings. The first particles 111 adjacent to the spherical second particle 112 may have a shape corresponding to a surface thereof. That is, the first particle 111 neighboring the second particle 112 may have a surface whose portion is concave. A surface of the concaved region may be a portion of the spherical shape.

Although FIG. 4 illustrates the shape in which the first and second particles 111 and 112 have different particle size distributions, three types of particles having different particle size distributions may be employed. Alternatively, a single type of particle can be used, which is illustrated in FIG. 5. In this case, only the first particle 111, which is plastically deformable, is contained in the body 101, and the first particle 111 may have a surface shape corresponding to a neighboring first particle 111 due to high pressure molding.

Figure 6:
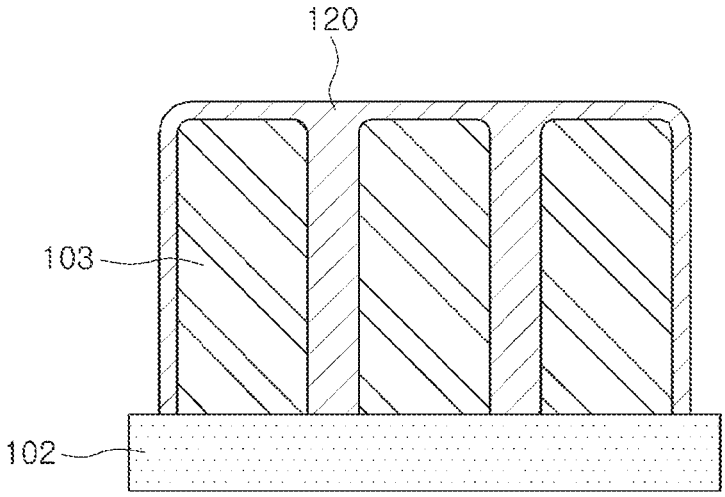
FIGS. 6 to 8 are diagrams schematically illustrating a coil portion employable in a modified coil portion and an insulating layer covering the same.
Figure 7:
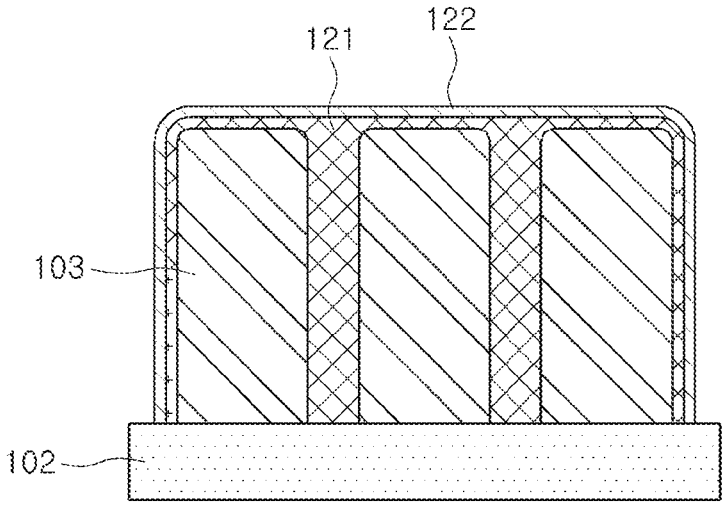
Figure 8:
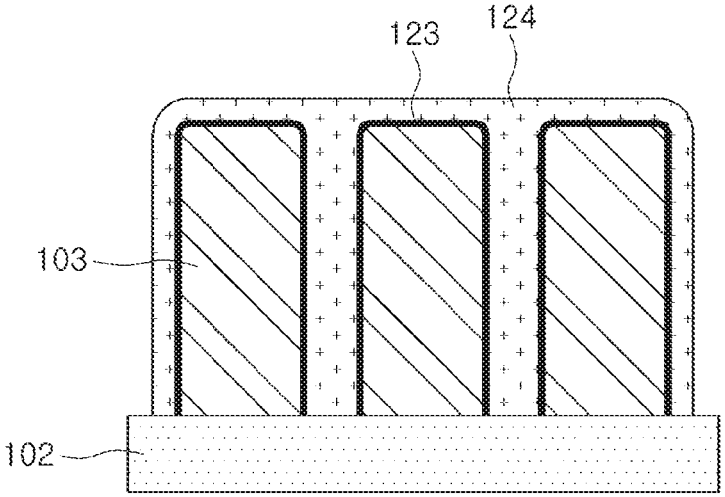

Meanwhile, when the body 101 is subject to high pressure molding, an insulating structure is required to insulate the coil portion 103 from the magnetic metal particles 111 and 112. As illustrated in FIGS. 6 to 8, an insulating layer covering the coil portion 103 may be employed. In the present disclosure, mechanical stability and insulating performance of the coil portion 103 are to be improved by employing a material and a shape of such an insulating layer appropriate for high pressure molding.

In an embodiment depicted in FIG. 6, the insulating layer 120 covers a surface of the coil portion 103; specifically, the insulating layer 120 may be integrally formed to cover side and upper surfaces of the coil portion 103. The insulating layer 120 may contain an F-type parylene. Compared to N-type parylene, the F-type parylene has excellent tensile and yield strength, thereby allowing the insulating layer 120 to more effectively protect the coil portion 103. Parylene is a group of polymers having a p-xylene structure. Parylene includes various types such as N-type, C-type, D-type, F-VT4-type and F-AT 4-type.

In an embodiment depicted in FIG. 7, the insulating layer includes a bilayer structure; specifically, a first layer 121 covers the side and upper surfaces of the coil portion 103 while a second layer 122 covers the first layer 121. Contrary to FIG. 6, parylene included in the insulating layer does not need to be limited to a particular type and thus the first layer 121 may contain parylene other than F-type parylene because the insulating layer has an additional insulating structure as the second layer 122. The second layer 122 contains an epoxy resin. The epoxy resin contained in the second layer 122 is advantageous for various types of precursors and composition designs. Besides, the epoxy resin has excellent adhesion and thus can serve to implement a more stable insulating structure.

FIG. 8 illustrates an insulating layer having a bilayer structure; specifically, a first layer 123 covers the side and upper surfaces of the coil portion 103 formed along a surface of the coil portion while a second layer 124 covers the first layer 123. The first layer 123 may be a layer formed by an atomic layer deposition (ALD) (an ALD layer) and may contain a ceramic material such as, for example, $Al_2O_3$, $TiO_2$, $ZrO_2$, or the like. The ALD layer may have a small thickness of several hundred nanometers, and accordingly, the first layer 123 may have a shape corresponding the surface structure of the coil portion 103. Such ALD layer has excellent insulating characteristics and strength despite the small thickness and may thus have a stable insulating structure. The second layer 124 may contain parylene or another material such as an epoxy resin.

As set forth above, in the coil component according to an exemplary embodiment in the present disclosure, a packing rate of a magnetic metal powder is improved in a body, thereby enhancing the characteristics such as inductance, or the like.

While exemplary embodiments have been shown and described above, it will be apparent to those skilled in the art that modifications and variations could be made without departing from the scope of the present invention as defined by the appended claims.

What is claimed is:

1. A coil component comprising:

a body comprising a support member and a coil portion embedded in one surface of the support member;

an insulating layer comprises: a first layer disposed on side and upper surfaces of the coil portion; and a second layer directly disposed on the first layer; and external electrodes connected to the coil portion, wherein the body comprises a plurality of metal particles, at least one of the plurality of metal particles comprise a first particle which is plastically deformable, and at least one of the first particles have a deformed surface and thus have a shape corresponding to a surface of a neighboring magnetic metal particle.

2. The coil component of claim 1, wherein the first particle comprises a Fe-based crystalline.

3. The coil component of claim 1, wherein the first particle comprises pure iron.

4. The coil component of claim 1, wherein the deformed surface of the first particle has a shape corresponding to a surface of a neighboring first particle.

5. The coil component of claim 1, wherein the deformed surface of the first particle has a concave portion, and the surface of the neighboring first particle has a convex portion in the form of being inserted into the concave portion.

6. The coil component of claim 1, wherein the plurality of magnetic metal particles comprises a second particle having a larger diameter than the first particle.

7. The coil component of claim 6, wherein the second particle comprises a material not plastically deformable.

8. The coil component of claim 6, wherein the second particle comprises a Fe-based amorphous alloy.

9. The coil component of claim 8, wherein the first particle comprises a Fe-based crystalline.

10. The coil component of claim 6, wherein at least one of the second particle has a spherical shape, and the first particle neighboring the spherical second particle has a shape corresponding to the surface of the spherical second particle.

11. The coil component of claim 6, wherein the first particle has a particle size of 10 μm or less, and the second particle has a particle size of 20 μm or above.

12. The coil component of claim 1, wherein the insulating layer has an integrated structure covering a side surface and an upper surface of the coil portion.

13. The coil component of claim 12, wherein the insulating layer comprises F-type parylene.

14. The coil component of claim 1, wherein the first layer comprises parylene, and the second layer comprises an epoxy resin.

15. The coil component of claim 1, wherein the first layer is an atomic layer deposition (ALD) layer, and the second layer comprises parylene.

16. The coil component of claim 3, wherein the pure iron comprises carbonyl iron powder (CIP).

17. The coil component of claim 14, wherein the parylene comprises F-type parylene.

18. The coil component of claim 15, wherein the parylene comprises F-type parylene.

* * * * *